US005405740A

United States Patent [19]

LaBelle

[11] Patent Number: 5,405,740

[45] Date of Patent: Apr. 11, 1995

[54] PROCESS FOR MANUFACTURING STABLE PHOTOTHERMOGRAPHIC ELEMENTS

[75] Inventor: Gary E. LaBelle, Hugo, Minn.

[73] Assignee: Minnesota Mining and Manufacturing Company, St. Paul, Minn.

[21] Appl. No.: 233,695

[22] Filed: Apr. 26, 1994

[51] Int. Cl.[6] ..... G03C 1/74; G03C 1/498

[52] U.S. Cl. ..... 430/619; 430/531; 430/935

[58] Field of Search ..... 430/619, 961, 935, 627, 430/531

[56] References Cited

U.S. PATENT DOCUMENTS

| | | | |
|---|---|---|---|
| 3,933,508 | 1/1976 | Ohkubo et al. | 430/619 |
| 4,055,432 | 10/1977 | Masuda et al. | 430/619 |
| 5,028,518 | 7/1991 | Lyons et al. | 430/506 |
| 5,028,523 | 7/1991 | Skoug | 430/617 |
| 5,188,931 | 2/1993 | Marinelli et al. | 430/539 |
| 5,196,301 | 3/1993 | Simpson et al. | 430/617 |

*Primary Examiner*—Thorl Chea

*Attorney, Agent, or Firm*—Gary L. Griswold; Walter N. Kirn; Mark A. Litman

[57] ABSTRACT

A process for the manufacture of a photothermographic element comprising the steps of:

a) providing a substrate, b) coating a first layer on said substrate, said first layer comprising an organic polymeric binder, silver halide, reducible silver salt or silver complex, and an organic solvent, c) before 70% of the solvent in said first layer is removed from said first layer, coating a second layer comprising a solvent and a second polymeric binder onto said first layer, said second polymeric binder comprising at least one cellulose ester, at least one of said first layer and said second layer containing a reducing agent for silver ion.

21 Claims, No Drawings

PROCESS FOR MANUFACTURING STABLE PHOTOTHERMOGRAPHIC ELEMENTS

FIELD OF THE INVENTION

This invention relates to photothermographic silver halide-containing elements and a method for producing such elements in a multilayer coating process so that the element demonstrates improved post development print stability, particularly in viewboxes. The multilayer coating system demonstrates improved stability over single layer coatings, even when using the same chemistry in both procedures.

BACKGROUND OF THE ART

Silver halide photothermographic imaging materials, often referred to as "dry silver" compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or neclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

Photothermographic emulsions tend to suffer from post development print stability when the Dmin areas are exposed to the high intensity light and heat from viewboxes. Traditional photothermographic materials have suffered from print stability. The minimum density areas darken when samples are left on viewboxes where the combination of light and heat tend to darken the background density. Adding to the difficulty of print stability is the fact that the developer, toners, and silver are incorporated in the photothermographic element which is not the case in most silver halide photographic systems. Likewise the light and heat from the viewbox are mere extensions of the light and heat used in the imaging of the sheet. The need for improved print stability is therefore always considered to be very important.

Many attempts have been made to improve the post development print stability of the photothermographic element. U.S. Pat. No. 4,012,260 describes improvements by adding 2-amino-2-thiazolinium carboxylates. U.S. Pat. No. 3,877,940 uses a precursor combination of a blocked thione and a halogen-containing stabilizer. U.S. Pat. No. 3,707,377 incorporates tribromoquinaldines and hexabromocyclohexane to suppress background discolouration. The addition of an image stabilizer precursor comprising 5-acetyl-4-methyl-2-(3-oxobuty-lthio) thiazole is used in U.S. Pat. No. 3,839,041. Oriental Photo Ind. Co. Ltd. in JP 0288039 stabilized the thermal sheet by adding tribromoacetophenone on a polyacrylic resin substrate to produce the stabilized sheet.

Tetrabromobutane is described as a post development print stabilizer in U.S. Pat. No. 4,108,665 and U.S. Pat. No. 4,288,536. Post-processing stabilization using amido compounds is described in EP 473 35 1 A2. The post-processing stability of silver halide photothermographic emulsions is enhanced with certain azlactones in EP 480 568 AZ. In U.S. Pat. No. 5,149,620 post-processing stability is improved by the addition of mercapto triazoles. However, these compounds were not found to produce sufficient post-development print stability on the photothermographic element for use in a view box.

BRIEF DESCRIPTION OF THE INVENTION

The combination of a specific family of resins with a particular coating method has been found to be a very effective system for improving the post-development print stability on photothermographic silver halide elements, particularly film elements. Cellulose ester resins, when single layer coated, demonstrate poor print stability. When these resins are coated as an overcoat or topcoat over a wet silver containing layer in a photothermographic element, a photothermographic sheet can be made with improved print stability properties.

DETAILED DESCRIPTION OF THE INVENTION

The generation of print-out in the Dmin areas of photothermographic elements comprising photosensitive silver halide, organic silver source (usually a silver salt or silver complex), and reducing agent for silver ion can be reduced by the use of a cellulose ester such as cellulose acetate, cellulose acetate butyrate, or cellulose acetate propionate in combination with multilayer coating methods. When the same resins (in the silver trip layer and the overcoat or top coat layers) are used in a single layer coating method, print stability is sacrificed. The multilayer coating techniques involves putting the first and second layers on top of each other in the wet state. The single layer coating method involves applying the first layer and drying the coating and then applying the second layer and drying the construction.

In normal coating procedures for multilayer photothermographic elements (particularly black-and-white photothermographic elements), the silver trip layer (the layer containing both the silver halide or its progenitor and the reducible silver source in a binder with a solvent, usually an organic solvent) is dried before the next layer, e.g., the overcoat layer, is applied over the silver trip layer. Drying usually entails removal of greater than 90% by weight of the organic solvent (or aqueous solvent) carrying the binder and silver ingredients. In the practice of the present invention, a wet silver trip layer is overcoated with a cellulose ester layer. In the practice of the present invention, a "wet layer" is a layer on a substrate which contains at least 30% by weight of the solvent concentration (with respect to binder) as was present in that layer when initially coated (i.e., from a slot coater, curtain coater, blade coater, etc.). Preferably at least 50% by weight, more preferably at least 70% by weight, and most preferably at least 80%, 90%, 95 %, or 100% of the solvent remains in the first down layer when the second layer (e.g., the cellulose ester layer) is coated on top of the first down layer.

The cellulose ester layer comprises at least a percentage of the cellulose ester binder. The higher the concentration of that class of binder, the better the results tend to be. It is preferred that at least 50% by weight of the binder in the second down layer (the top coat or overcoat layer) comprises the cellulose ester. More preferably the overcoat layer comprises at least 75%, more preferably at least 90%, and most preferably 100% of the cellulose ester materials. Although any binder be used for the first down silver trip layer, the preferred film forming organic polymeric binder for that layer is a polyvinyl acetal, and most preferably polyvinyl butyral.

The process of the present invention may be generally described as a) providing a substrate (preferably a transparent polymeric film), coating a first layer on said substrate, the first layer comprising a silver halide (or pregenitor), reducible silver source (e.g., silver salt or silver complex), organic polymeric binder resin, and a solvent (usually for the polymeric binder), b) coating a second layer on said first layer before the first layer has been dried (e.g., before 70% of the solvent in the first coated layer has been removed), and then drying the photothermographic element (e.g., to remove at least 90% by weight of the total solvent in the two layers, collectively). At least one of the two coated layers will contain the reducing agent for silver ion which is essential to the photothermographic process.

At least the silver trip, the adjacent cellulose ester layer or another layer adjacent to the silver trip layer must contain the reducing agent for silver ion necessary for photothermographic elements. Other desired ingredients may be distributed within these two layers or other layers.

The photothermographic emulsions of this invention may be constructed of two or more layers on a substrate. Two layer constructions must contain the silver source and silver halide in one emulsion layer (usually the layer adjacent to the substrate) and some of the other ingredients in the second layer or both layers, although two layer constructions comprising a single emulsion layer containing all the ingredients and a protective topcoat are envisioned. Multicolor photothermographic constructions may contain sets of these bilayers for each color, or they may contain all ingredients within a single layer as described in U.S. Pat. No. 4,708,928. In the case of multilayer multicolor photothermographic articles the various emulsion layers are generally maintained distinct from each other by the use of functional or non-functional barrier layers between the various photosensitive layers as described in U.S. Pat. No. 4,460,681.

While not necessary for practice of the present invention, it may be advantageous to add mercury (II) salts to the emulsion layer(s) as an antifoggant. Preferred mercury (II) salts for this purpose are mercuric acetate and mercuric bromide.

The light sensitive silver halide used in the present invention may typically be employed in a range of 0.75 to 25 mol percent and, preferably, from 2 to 20 mol percent of organic silver salt.

The silver halide may be any photosensitive silver halide such as silver bromide, silver iodide, silver chloride, silver bromoiodide, silver chlorobromoiodide, silver chlorobromide, etc.

The silver halide may be in any form which is photosensitive including, but not limited to cubic, orthorhombic, tabular, tetrahedral, etc., and may have epitaxial growth of crystals thereon.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in T. H. James "The Theory of the Photographic Process", Fourth Edition, Chapter 5, pages 149 to 169.

The silver halide may be added to the emulsion layer in any fashion which places it in catalytic proximity to the silver source. Silver halide and the organic silver salt which are separately formed or "preformed" in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are known in the art and described in Research Disclosure, June 1978, item 17029, and U.S. Pat. No. 3,700,458.

The use of preformed silver halide emulsions of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to cubic, tetrahedral, orthorhombic, tabular, laminar, platelet, etc.

The organic silver salt may be any organic material which contains a reducible source of silver ions. Silver salts of organic acids, particularly long chain (10 to 30 preferably 15 to 28 carbon atoms) fatty carboxylic acids are preferred. Complexes of organic or inorganic silver salts wherein the ligand has a gross stability constant between 4.0 and 10.0 are also desirable.

The silver source material should preferably constitute from about 5 to 30 percent by weight of the imaging layer.

The organic silver salt which can be used in the present invention is a silver salt which is comparatively stable to light, but forms a silver image when heated to 80° C. or higher in the presence of an exposed photocatalyst (such as photographic silver halide) and a reducing agent.

Preferred organic silver salts include silver salts of organic compounds having a carboxy group. Non-limiting examples thereof include silver salts of an aliphatic carboxylic acid and a silver salt of an aromatic carboxylic acid. Preferred examples of the silver salts of aliphatic carboxylic acids include silver behenate, silver stearate, silver oleate, silver laurate, silver caproate, silver myristate, silver palmitate, silver maleate, silver fumarate, silver tartrate, silver linoleate, silver butyrate and silver camphorate, mixtures thereof, etc. Silver salts with a halogen atom or a hydroxyl on the aliphatic carboxylic acid can also be effectively used. Preferred examples of the silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can also be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)benzothiazole, a silver salt of thioglycolic acid such as a silver salt of an S-alkyl thioglycolic acid (wherein the alkyl group has from 12 to 22 carbon atoms), a silver salt of a dithiocarboxylic acid such as a silver salt of dithioacetic acid, a silver salt of a thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of a thione compound such as a silver salt of 3-(2-carboxyethyl)-4-methyl-4-thiazoline-2thione as disclosed in U.S. Pat. No. 3,301,678.

Furthermore, a silver salt of a compound containing an imino group may be used. Preferred examples of these compounds include silver salts of benzotriazole and derivatives thereof, for example, silver salts of benzothiazole such as silver methylbenzotriazolate, etc., silver salt of halogen-substituted benzotriazoles, such as silver 5-chlorobenzotriazolate, etc., silver salts of carboimidobenzotriazole, etc., silver salt of 1,2,4-triazoles or 1-H-tetrazoles as described in U.S. Pat. No. 4,220,709, silver salts of imidazoles and imidazole derivatives, and the like. Various silver acetylide compounds can also be used, for instance, as described in U.S. Pat. Nos. 4,761,361 and 4,775,613.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver may be used.

The method used for making silver soap dispersions is well known in the art and is disclosed in Research Disclosure, April 1983, item 22812, Research Disclosure, October 1983, item 23419 and U.S. Pat. No. 3,985,565.

The light-sensitive silver halides may be advantageously spectrally sensitized with various known dyes including cyanine, merocyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Practically, the sensitizing dyes to be used in the present invention may be properly selected from known dyes such as those described in U.S. Pat. Nos. 3,761,279; 3,719,495; and 3,877,943; British Pat. Nos. 1,466,201; 1,469,117; and 1,422,057; and can be located in the vicinity of the photocatalyst according to known methods. Spectral sensitizing dyes may be typically used in amounts of about 10–4 mol to about 1 mol per 1 mol of silver halide.

The reducing agent for the organic silver salt may be any material, preferably organic material, that can reduce silver ion to metallic silver. Conventional photographic developers such a phenidone, hydroquinones, and catechol are useful but hindered phenol reducing agents are preferred. The reducing agent should be present as 1 to 10 percent by weight of the imaging layer. In multilayer constructions, if the reducing agent is added to a layer other than an emulsion layer, slightly higher proportions, of from about 2 to 15 percent tend to be more desirable.

A wide range of reducing agents have been disclosed in dry silver systems including amidoximes such as phenylamidoxime, 2-thienylamidoxime and p-phenoxyphenylamidoxime, azines (e.g., 4-hydroxy-3,5dimethoxybenzaldehydeazine); a combination of aliphatic carboxylic acid aryl hydrazides and ascorbic acid, such as 2,2'-bis(hydroxymethyl)propionyl-B-phenylhydrazide in combination with ascorbic acid; a combination of polyhydroxybenzene and hydroxylamine, a reductone and/or a hydrazine (e.g., a combination of hydroquinone and bis(ethoxyethyl)hydroxylamine, piperidinohexose reductone or formyl-4-methylphenylhydrazine); hydroxamic acids such as phenylhydroxamic acid, p-hydroxyphenylhydroxamic acid, and B-alaninehydroxamic acid; a combination of azines and sulfonamidophenols, (e.g., phenothiazine and 2,6-dichloro-4-benzenesulfonamidophenol); a-cyanophenylacetic acid derivatives such as ethyl-a-cyano-2-methylphenylacetate, ethyl a-cyanophenylacetate; bis-B-naphthols as illustrated by 2,2'-dihydroxyl- 1-binaphthyl, 6,6'-dibromo-2,2'-dihydroxy-1,1'-binaphthyl, and bis(2-hydroxy-1-naphthyl)methane; a combination of bis-B-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidonehexose reductone; sulfonamido-phenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarboethoxy- 1,4-dihydropyridine; bisphenols (e.g., bis(2-hydroxy-3-t-butyl-5-methylphenyl)methane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane); ascorbic acid derivatives (e.g., 1-ascorbyl palmitate, ascorbyl stearate); and unsaturated aldehydes and ketones, such as benzil and biacetyl; 3-pyrazolidones and certain indane-1,2-diones.

In addition to the aforementioned ingredients, it may be advantageous to include additives known as "toners" that improve the image. Toner materials may be present, for example, in amounts from 0.1 to 10 percent by weight of all silver bearing components. Toners are well known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline, and 2,4-thiazolidinedione; naphthalimides (e.g., N-hydroxy-1,8-naphthalimide); cobalt complexes (e.g., cobaltic hexammine trifluoroacetate); mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, (e.g., (N,N-dimethylaminomethyl)phthalimide, and N,N-(dimethylaminomethyl)naphthalene-2,3-dicarboximide); and a combination of blocked pyrazoles, isothiuronium derivatives and a certain photobleaching agents (e.g., a combination of N,N'-hexamethylene his(1-carbamoyl-3,5-dimethylpyrazole), 1,8-(3,6-diazaoctane)bis(isothiuronium trifluoroacetate) and 2-(tribromomethylsulfonyl)benzothiazole); and merocyanine dyes such as 3-ethyl-5[(3-ethyl-2-benzothiazolinylidene)-1-methylethylidene]-2-thio-2,4-oxazolidinedione; phthalazinone, 6-chlorophthalazinone, 5,7-dimethoxyphthalazinone, and 2,3-dihydro-1,4-phthalazineclione; a combinatin of phthalazinone plus sulfinic acid derivatives (e.g., phthalic acid, 4-methylphthalic acid, 4-nitrophthalic acid, and tetrachlorophthalic anhydride); quinozolinediones, benzoxazine or naphthoxazine derivatives; rhodium complexes functioning not only as tone modifiers, but also as sources of halide ion for silver halide formation in situ, such as ammonium hexachlororhodate (III),, rhodium bromide, rhodium nitrate and potassium hexachlororhodate (III); inorganic peroxides and persulfates (e.g., ammonium peroxydisulfate and hydrogen peroxide); benzoxazine-2,4-diones such as 1,3-benzoxazine-2,4-dione, 8-methyl- 1,3-benzoxazine-2,4-dione, and 6-nitro-1,3-benzoxazine-2,4-dione; pyrimidines and asymmetric triazines (e.g., 2,4-dihydroxypyrimidine, 2-hydroxy-4-aminopyrimidinee), azauracils, and tetrazapentalene derivatives (e.g., 3,6-dimercapto-1,4-diphenyl-1H, 4H-2,3a,5,6a-tetrazapentalene, and 1,4-di(o-chlorophenyl)-3,6-dimercapto- 1H,4H-2,3a,5,6a-tetrazapent alene).

A number of methods are known in the art for obtaining color images with dry silver systems including: a combination of silver benzotrazole, well known magenta, yellow and cyan dye-forming couplers, aminophenol developing agents, a base release agent such as guanidinium trichloroacetate and silver bromide in poly(vinyl butyral) as described in U.S. Pat. Nos. 4,847,188 and 5,064,742; preformed dye release systems such as those described in U.S. Pat. No. 4,678,739; a combination of silver bromoiodide, sulfonamidaphenol reducing agent, silver behenate, poly(vinyl butyral), an amine such as n-octadecylamine and 2-equivalent or 4-equivalent cyan, magenta or yellow dye-forming couplers; leuco dye bases which oxidize to form a dye image (e.g., Malachite Green, Crystal Violet and pararosaniline); a combination of in situ silver halide, silver behenate, 3-methyl-1-phenylpyrazolone and N,N'-dimethyl-p-phenylenediamine hydrochloride; incorporating phenolic leuco dye reducing agents such as 2(3,5-di-(t-butyl)-4-hydroxyphenyl)-4,5-diphenylimidazole, and bis(3,5-di-(t-butyl)-4-hydroxyphenyl)phenylmethane, incorporating azomethine dyes or azo dye reducing agents; silver dye bleach processes (for example, an dement comprising silver behenate, behenic acid, poly(-vinyl butyral), poly(vinyl-butyral)peptized silver bromoiodide emulsion, 2,6-dichloro-4-benzenesulfonamidophenol, 1,8-(3,6-diazooctane)bis(isothiuronium-p-toluenesulfonate) and an azo dye can be exposed and heat processed to obtain a negative silver image with a uniform distribution of dye, and then laminated to an acid activator sheet comprising polyacrylic acid, thiourea and p-toluenesulfonic acid and heated to obtain well defined positive dye images); and amines such as aminoacetanilide (yellow dye-forming), 3,3'-dimethoxybenzidine (blue dye-forming) or sulfanilide (magenta dye forming) that react with the oxidized form of incorporated reducing agents such as 2,6-dichloro-4-benzenesulfonamidophenol to form dye images. Neutral dye images can be obtained by the addition of amines such as behenylamine and p-anisidine.

Leuco dye oxidation in such silver halide systems for color formation is disclosed in U.S. Pat. Nos. 4,021,240; 4,374,821; 4,460,681, and 4,883,747.

Emulsions of the invention can contain plasticizers and lubricants such as polyalcohols (e.g., glycerin and diols of the type described in U.S. Pat. No. 2,960,404); fatty acids or esters such as those described in U.S. Pat. No. 2,588,765 and U.S. Pat. No. 3,121,060; and silicone resins such as those described in British Pat. No. 955,061.

The emulsions of the present invention may contain additional stabilizers and antifoggants known in the photothermographic art. These may be primary stabilizers and antifoggants or post-processing stabilizers. Amongst the preferred antifoggants are organic compounds having trihalogenated and especially tribromomethyl groups. These are often aryl (aromatic) nuclei having the halogenated group either directly attached to the aromatic nucleus or attached through a bridging group (e.g., sulfonyl). Other useful antifoggants include isocyanates, vinyl sulfones, and beta-halogenated sulfones.

The photothermographic elements of the present invention may include image dye stabilizers. Such image dye stabilizers are illustrated by British Pat. No. 1,326,889; U.S. Pat. Nos. 3,432,330; 3,698,909; 3,574,627; 3,572,050; 3,764,337 and 4,042,394.

Photothermographic elements containing emulsion layers according to the present invention can be used in photographic elements which contain light absorbing materials and filter dyes such as those described din U.S. Pat. Nos. 3,253,921; 2,274,782; 2,527,583 and 2,956,879. if desired, the dyes can be mordanted, for example, as described in U.S. Pat No. 3,282,699.

Photothermographic elements containing emulsion layers as described herein can contain matting agents such as starch, titanium dioxide, zinc oxide, silica, polymeric beads including beads of the type described in U.S. Pat. No. 2,992,101 and U.S. Pat. No. 2,701,245.

Emulsions in accordance with this invention can be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056 and 3,206,312 or insoluble inorganic salts such as those described in U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymers are polyvinyl butyral, and cellulose esters.

Optionally, these polymers may be used in combinations of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing a stabilizer according to the present invention may be coated on a wide variety of supports. Typical supports include polyester film, subbed polyester film, poly(thylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which may be partially acetylated or coated with baryta and/or an a-olefin polymer, particularly a polymer of an a-olefin containing 2 to 10 carbon atoms such as polyethylene, polypropylene, ethylene-butene copolymers and the like. Substrates may be transparent or opaque.

Substrates with a backside resistive heating layer may also be used in photothermographic imaging systems such as shown in U.S. Pat. Nos. 4,460,681 and 4,374,921.

Photothermographic emulsions of this invention can be coated by various coating procedures including curtain coating, slide coating, slot coating or extrusion coating using hoppers of the type described in U.S. Pat. No. 2,681,294. If desired, two or more layers may be coated simultaneously by the procedures described in U.S. Pat. No. 2,761,791 and British Pat. No. 837,095.

Additional layers may be incorporated into photothermographic articles of the present invention such as dye receptive layers for receiving a mobile dye image, an opacifying layer when reflection prints are desired, a protective topcoat layer and a primer layer as is known in the photothermographic art. Additionally, it may be desirable in some instances to coat different emulsion layers on both sides of a transparent substrate, especially when it is desirable to isolate the imaging chemistries of the different emulsion layers.

The present invention will be illustrated in detail in the following examples, but the embodiment of the present invention is not limited thereto.

EXAMPLE I

A silver halide-silver behenate dry soap was prepared by the procedures described in U.S. Pat. No. 3,839,049. The silver halide totalled 9% of the total silver while silver behenate comprised 91% of the total silver. The silver halide was a 0.055 micron silver bromoiodide emulsion with 2% iodide.

A photothermographic emulsion was prepared by homogenizing 300 g of the silver halide-silver behenate dry soap described above with 525 g toluene, 1675 g 2-butanone and 50 g poly(vinylbutyral) (B-79, Monsanto).

The homogenized photothermographic emulsion 534 g and 27.5 g of 2-butanone was cooled to 55° F. with stirring. Pyridinium hydrobromide perbromide 0.65 g in 5 gm MeOH was added and stirred for 2 hours. The addition of 4.75 ml of a calcium bromide solution (1 g of CaBr2 and 10 ml of methanol) was followed by 30 minutes of stirring. Additional poly(vinylbutyral) (110 g B-79) was added and stirred for 60 minutes. The temperature was held at 55° F. and the following were added in 15 minute increments with stirring: Premix I in Methanol 4.32 g of 2-(4-chlorobenzoyl)benzoic acid, Dye 0.0803 gins 3,3[1] dihexanoic acid-2,2[1]-thiatricarbocyanine, supersensitizer 0.382 g Methylmercaptobenzimidazole (MMBI), 22 g Methanol. 16.73 g 1,1-bis(2-hydroxy-3,5-dimethylphenyl)-3,5,5-trimethylhexane.

2.5 gms 2-tribromomethylsulfonyl guinaldine. Isocyanate solution 1.02 g Desmodur N3300 in 6 g 2-butanone.

An active, protective topcoat solution was prepared with the following ingredients:

81.2 g 2-butanone
9.59 g methanol
7.7 g cellulose acetate butyrate, Eastman Kodak (CAB 171-15S)
0.53 g phthalazine (PhZ)
0.26 g 4-methylphthalic acid (4-MPA)
0.17 g tetrachlorophthalic acid (TCPA)
0.26 g MRA-1 (a surfactant used as a Mottle Reducing Agent)

MRA-1 is a tertiary polymer made up of N-ethyl perflourooctanesulfonyl amidoethyl methacrylate/hydroxyethyl methacrylate/acrylic acid in a weight ratio of 70/20/10.

The resulting composition was divided into two 20 g portions. Each 20 g portion of topcoat was just sufficient to coat a 35 g aliquot of the silver formula described previously.

The first coating was done by coating the silver formula on the 3 mil polyester film using the knife coater set at 4.2 mils above the base. The coating was dried at 170° F. for 3 minutes and reset in the knife coating machine at 3.5 mils gap over the 1.95 gm/ft$^2$ dried silver layer. The second layer or topcoat layer was likewise dried at the same conditions. This method of sequential coating, drying, coating, drying will be referred to as the single layer coating technique.

The second aliquot of silver and topcoat from example 1 were multilayer coating, i.e. the knife coater was set up with two simultaneous coating bars or knives separated by a six inch distance. The same substrate was used. The rear bar was set at 4.2 mils and the front bar was set at 5.6 mils or 1.4 mils over the wet silver layer. Both the silver and topcoat were multilayer coated by pouring the silver emulsion on the film prior to the rear knife and pouring the topcoat on the film prior to the front bar. The film was then drawn forward so that both layers are coated simultaneously resulting in a single pass-multilayer method. The drying conditions were not changed. The temperature was 170° F. for three minute duration.

The coated materials were then exposed with a laser sensitometer incorporating an 811 nm diode. After exposure, the film strips were processed at 250° F. for 15 seconds. The images obtained were evaluated by a densitometer. Sensitometric results include Dmin, DHi (density measured at 1.4 Log E above Dmin +0.20), speed (Spd 2=relative speed at a density of 1.05 above Dmin) and average contrast (AC-1, measured as the slope of the line joinning density points of 0.25 and 2.0 above Dmin). The sensitometry was evaluated shortly after coating.

The sample set was also exposed in like manner and processed at 260° F. for 15 seconds. This was done to develop the sample with additional energy to study the coating method on Drain or fog. The processed samples were then tested for post development print stability. This test involved placing samples in a controlled light box set up at 1200 footcandles using fluorescent bulbs, 113° F. temperature and 20% relative humidity. The samples are then placed in the light box for 24 hours with the developed emulsion side up towards the light bank. The Dmin is measured using a neutral and blue filter in a Macbeth TD 528 densitometer. The delta Dmin ($Dmin@T_{24}$-$Dmin@T_0$) is recorded. A second test was performed using a Maxant lightbox set at 125° F. surface temperature to examine the delta Dmin at this higher temperature. The results are compiled in Table I showing how the multilayer coating technique not only improves the development latitude by keeping the fog level down in over development condition but it unexpectedly improves the print stability in the lightboxes.

TABLE 1

| Resin | Coating Method | 811 nm Sensitometry Dmin | DHi | Spd 2 | AC-1 | Unprocessed Haze | Processed Haze |
|---|---|---|---|---|---|---|---|
| | | 15 sec - 250° F. | | | | | |
| CAB171-15S | Dual | .09 | 3.44 | 1.60 | 3.9 | 14.5 | 13.5 |
| CAB171-15S | Single | .10 | 3.19 | 1.66 | 3.5 | 16.5 | 17.3 |
| | | 15 sec - 260° F. | | | | | |
| CAB171-15S | Dual | .11 | 3.13 | 1.71 | 3.5 | | |
| CAB171-15S | Single | .15 | 3.15 | 1.74 | 3.1 | | |

Print Stability of Samples Processed for 15 sec/250° F.

| Resin | Coating Method | ΔDmin Visible Filter 113° F. 24 Hrs. | ΔDmin Blue Filter 113° F. 24 Hrs. | ΔDmin Visible Filter 125° F. 24 Hrs | ΔDmin Blue Filter 125° F. 24 Hrs |
|---|---|---|---|---|---|
| CAB171-15S | Dual | .16 | .24 | .37 | .37 |
| AB171-15S | Single | .57 | .54 | .82 | .77 |

EXAMPLE II

Other Cellulose Acetate Esters also demonstrate the improved print stability and development latitude when coated in a multilayer or dual mode. The silver layer was the same as Example I. The percentage of resin was adjusted for viscosity. The topcoats were made with various resins.

| IIA Topcoat Formula | |
|---|---|
| MEK | 81.22 |
| MeOH | 9.59 |
| Cellulose Acetate Propionate - 482-20 | 6.0 |
| 4 MPA | 0.259 |
| TCPA | 0.173 |
| PhZ | 0.527 |
| MRA-1 (16% solids) | 0.256 |
| **IIB Topcoat Formula** | |
| MEK | 81.22 |
| MeOH | 9.59 |
| Cellulose Acetate Propionate - 482-0.5 | 20.0 |
| 4 MPA | 0.259 |
| TCPA | 0.173 |
| PhZ | 0.527 |
| MRA-1 (16% solids) | 0.256 |
| **IIC Topcoat Formula** | |
| MEK | 81.22 |
| MeOH | 9.59 |
| Cellulose Acetate Propionate - 504-.2 | 20.0 |
| 4 MPA | 0.259 |
| TCPA | 0.173 |
| PhZ | 0.527 |
| MRA-1 (16% solids) | 0.256 |
| **IID Topcoat Formula** | |
| MEK | 81.22 |
| MeOH | 9.59 |
| Cellulose Acetate 394-60 | 6.0 |
| 4 MPA | 0.259 |
| TCPA | 0.173 |
| PhZ | 0.527 |
| MRA-1 (16% solids) | 0.256 |
| **IIE Topcoat Formula** | |
| MEK | 81.22 |
| MeOH | 9.59 |
| Cellulose Acetate 398-6 | 20.0 |
| 4 MPA | 0.259 |
| TCPA | 0.173 |
| PhZ | 0.527 |
| MRA-1 (16% solids) | 0.256 |
| **IIF Topcoat Formula** | |
| MEK | 81.22 |
| MEOH | 9.59 |
| Cellulose Acetate Butyrate 381-20 | 8.0 |
| 4 MPA | 0.259 |
| TCPA | 0.173 |
| PhZ | 0.527 |
| MRA-1 (16% solids) | 0.256 |
| **IIG Topcoat Formula** | |
| MEK | 81.22 |
| MEOH | 9.59 |
| Cellulose Acetate Butyrate 171-155 | 8.0 |
| Gelva V-7 (Monsanto) | 8.0 |
| 4 MPA | 0.259 |
| TCPA | 0.173 |
| PhZ | 0.527 |
| MRA-1 (16% solids) | 0.256 |

Each example was coated exactly the same as Example I in both the single and multilayer modes. All were tested the same as Example I. The sensitometry and print stability data is in Table II.

TABLE II 811 nm
15 sec - 250° F.

TABLE II-continued

| Example | Resin | Coating Method | Sensitometry Dmin | DHi | Spd 2 | AC-1 |
|---|---|---|---|---|---|---|
| IIA | CAP482-20 | Dual | .10 | 3.96 | 1.49 | 3.7 |
| IIA | CAP482-20 | Single | .11 | 3.23 | 1.61 | 3.7 |
| IIB | CAP482-.5 | Dual | .10 | 3.63 | 1.54 | 3.1 |
| IIB | CAP482-.5 | Single | .09 | 3.26 | 1.46 | 2.9 |
| IIC | CAP504-.2 | Dual | .10 | 3.61 | 1.45 | 2.8 |
| IIC | CAP504-.2 | Single | .10 | 3.41 | 1.52 | 3.2 |
| IID | CA-396-60 | Dual | .11 | 3.24 | 1.65 | 3.1 |
| IID | CA-396-60 | Single | .13 | 3.41 | 1.77 | 3.6 |
| IIE | CA-398-6 | Dual | .12 | 3.38 | 1.73 | 3.9 |
| IIE | CA-398-6 | Single | .16 | 4.05 | 1.80 | 3.4 |
| IIF | CAB381-20 | Dual | .09 | 3.42 | 1.73 | 3.6 |
| IIF | CAB381-20 | Single | .08 | 3.46 | 1.72 | 3.9 |
| IIG | CAB171 + Gelva V71 | Dual | .09 | 3.40 | 1.78 | 3.7 |
| IIG | CAB171 + Gelva V71 | Single | .10 | 3.44 | 1.88 | 3.7 |
| | | | 15 sec - 260° F. | | | |
| IIA | CAP482-20 | Dual | .13 | 3.52 | 1.57 | 3.8 |
| IIA | CAP482-20 | Single | .19 | 3.14 | 1.68 | 3.2 |
| IIB | CAP482-.5 | Dual | .12 | 3.46 | 1.53 | 2.7 |
| IIB | CAP482-.5 | Single | .12 | 3.21 | 1.59 | 2.9 |
| IIC | CAP504-.2 | Dual | .17 | 3.48 | 1.61 | 3.4 |
| IIC | CAP504-.2 | Single | .13 | 3.26 | 1.52 | 2.6 |

Print Stability
15 Sec - 250° F. Processing

| Example | Resin | Coating Method | ΔDmin Visible Filter 24 Hrs 113° F. | ΔDmin Blue Filter 24 Hrs 113° F. | ΔDmin Visible Filter 24 Hrs 125° F. | ΔDmin Blue Filter 24 Hrs 125° F. |
|---|---|---|---|---|---|---|
| IIA | CAP482-20 | Dual | .13 | .28 | .26 | .29 |
| IIA | CAP482-20 | Single | .28 | .34 | .59 | .56 |
| IIB | CAP482-.5 | Dual | .05 | .12 | .17 | .21 |
| IIB | CAP482-.5 | Single | .08 | .16 | .22 | .23 |
| IIC | CAP504-.2 | Dual | .01 | .06 | .12 | .14 |
| IIC | CAP504-.2 | Single | .09 | .15 | .20 | .23 |
| IID | CA394-60 | Dual | .20 | .31 | .11 | .09 |
| IID | CA394-60 | Single | .39 | .49 | .34 | .34 |
| IIE | CA398-6 | Dual | .11 | .23 | .09 | .06 |
| IIE | CA398-6 | Single | .28 | .49 | .25 | .34 |
| IIF | CAB381-20 | Dual | .22 | .37 | .22 | .39 |
| IIF | CAB381-20 | Single | .40 | .53 | .55 | .74 |
| IIG | CAB171 + Gelva V7 | Dual | .40 | .70 | .86 | .96 |
| IIG | CAB171 + Gelva V7 | Single | .76 | .87 | 1.14 | 1.26 |

| Resin | Coating Method | ΔDmin Visible Filter 24 Hours Lightbox 113° F. | ΔDmin Blue Filter 24 Hours Lightbox 113° F. |
|---|---|---|---|
| CAP482-20 | Dual | .23 | .40 |
| CAP482-20 | Single | .45 | .59 |
| CAP482-.5 | Dual | .11 | .21 |
| CAP482-.5 | Single | .20 | .28 |
| CAP504-.2 | Dual | .06 | .14 |
| CAP504-.2 | Single | .14 | .22 |

EXAMPLE III

Additional compounds were examined to determine the extent of the invention. The silver formula was the same as Example I. The topcoats were made with resin and toners. A premix was made for each topcoat consisting of the resin and solvents. The premix per-cent solids was adjusted to give a viscosity in the 10–200 cps range. The premix formulations and viscosities are listed. The day before coating 0.55 g PHZ, 0.27 g 4-MPA, and 0.18 g TCPA were added to 100 g of resin premix and mixed until dissolved. These samples for Example III were coated using the multilayer coating technique and tested for sensitometry using a 811 nm laser for exposing and processed at 15 seconds −250° F. on the same processor as used in Examples I and II. The print stability tests were done in the same light chamber as described in Examples I and II. The light stability described in the following examples use the code: 24 hr/V=24 hours in the light box using the visual filter on the densitometer. Delta Dmin is reported. 24 hr/B=24 hours in the light box measured with the blue filter. Initial sensitometric measurements of Drain, Dmax, Spd Pt=SPD2, Cont C=AC-1. SPD2 and AC-1 were taken as described above.

| RESIN | RESIN PREMIX COMPOSITION | INITIAL | | LIGHT STABILITY | |
|---|---|---|---|---|---|
| Nitrocellulose | 5% Resin | Dmin | 0.20 | 24 hr/V | 0.80 |
| RS½sec. | 84% MEK | Dmax | 1.00 | 24 hr/B | n.m. |

-continued

| RESIN | RESIN PREMIX COMPOSITION | INITIAL | | LIGHT STABILITY | |
|---|---|---|---|---|---|
| | 10% ETOH | Spd Pt | *** | | |
| (Hercules) | +2% MRA-1 | | | | |
| Nitrocellulose | 5% Resin | Dmin | 0.18 | 24 hr/V | 0.96 |
| FM200 | 84% MEK | Dmax | 1.44 | 24 hr/B | n.m. |
| | 10% ETOH | Spd Pt | 0.75 | | |
| (Daicel) | | | | | |
| Nitrocellulose | 5% Resin | Dmin | 0.16 | 24 hr/V | 0.67 |
| FM200 | 84% MEK | Dmax | 1.82 | 24 hr/B | n.m. |
| | 10% ETOH | Spd Pt | 0.95 | | |
| (Daicel) | +2% MRA-1 | | | | |
| VYNS-3 | 12% Resin | Dmin | 0.26 | 24 hr/V | 1.95 |
| 90% PVC | 78% MEK | Dmax | 3.83 | 24 hr/B | 2.03 |
| 10% PVAC | 10% ETOH | Spd Pt | 2.03 | | |
| (Union Carbide) | | Cont C | 4.14 | | |
| VYHD | 20% Resin | Dmin | 0.24 | 24 hr/V | 1.37 |
| 86% PVC | 70% MEK | Dmax | 3.46 | 24 hr/B | 1.52 |
| 14% PVAC | 10% ETOH | Spd Pt | 2.06 | | |
| (Union Carbide) | | Cont C | 3.90 | | |
| VMCH | 20% Resin | Dmin | 0.21 | 24 hr/V | 1.87 |
| 86% PVC | 70% MEK | Dmax | 3.35 | 24 hr/B | 2.06 |
| 13% PVAC | 10% ETOH | Spd Pt | 2.40 | | |
| 1% Maleic Acid | | Cont C | 3.85 | | |
| (Union Carbide) | | | | | |
| VMCA | 25% Resin | Dmin | 0.12 | 24 hr/V | 1.36 |
| 81% PVC | 65% MEK | Dmax | 3.24 | 24 hr/B | 1.63 |
| 17% PVAC | 10% ETOH | Spd Pt | 1.71 | | |
| 2% Maleic Acid | | Cont C | 2.65 | | |
| (Union Carbide) | | | | | |
| VAGH | 15% Presin | Dmin | 0.13 | 24 hr/V | 1.03 |
| 90% PVC | 75% MEK | Dmax | 3.33 | 24 hr/B | 1.20 |
| 4% PVAC | 10% ETOH | Spd Pt | 1.80 | | |
| 6% PVAl | | Cont C | 3.24 | | |
| (Union Carbide) | | | | | |
| VROH | 25% Resin | Dmin | 0.14 | 24 hr/V | 1.40 |
| 81% PVC | 65% MEK | Dmax | 3.46 | 24 hr/B | 1.54 |
| 4% PVAC | 10% ETOH | Spd Pt | 1.84 | | |
| 15% HO-R-Acrylate | | Cont C | 3.49 | | |
| (Union Carbide) | | | | | |
| VYES | 25% Resin | Dmin | 0.16 | 24 hr/V | 1.08 |
| 67% PVC | 65% MEK | Dmax | 3.06 | 24 hr/B | 1.32 |
| 11% PVAC | 10% ETOH | Spd Pt | 1.59 | | |
| 22% HO-R-Acrylate | | Cont C | 1.95 | | |
| (Union Carbide) | | | | | |
| Nitrocellulose | 12% Resin | Dmin | 0.75 | 24 hr/V | 0.77 |
| RS ½ sec | 78% MEK | Dmax | 1.22 | 24 hr/B | 1.22 |
| As Received | 10% ETOH | Spd Pt | *** | | |
| | | Cont C | *** | | |
| (Hercules) | | | | | |
| Versamid 940 | 15% Resin | Dmin | 0.14 | 24 hr/V | 0.52 |
| Polyamide | 28% MEK | Dmax | 3.22 | 24 hr/B | 0.79 |
| | 28% Toluene | Spd Pt | 1.81 | | |
| General Mills | 28% ETOH | Cont C | 3.61 | | |
| Versalon 1164 | 15% Resin | Dmin | 0.11 | 24 hr/V | 0.49 |
| Polyamide | 42% Toluene | Dmax | 2.84 | 24 hr/B | 0.84 |
| | 42% ETOH | Spd Pt | 1.68 | | |
| General Mills | | Cont C | 2.18 | | |
| Emerez 1532 | 15% Resin | Dmin | 0.13 | 24 hr/V | 0.59 |
| Polyamide | 42% Toluene | Dmax | 3.05 | 24 hr/B | 0.86 |
| | 42% ETOH | Spd Pt | 1.85 | | |
| Emery | | Cont C | 3.09 | | |
| PKHH | 15% Resin | Dmin | 0.21 | 24 hr/V | 0.36 |
| Phenoxy Resin | 38% MEK | Dmax | 2.27 | 24 hr/B | 0.60 |
| | 38% Toluene | Spd Pt | 1.79 | | |
| Union Carbide | 10% ETOH | Cont C | *** | | |
| Styron 685D | 15% Resin | Dmin | 0.22 | 24 hr/V | 1.30 |
| Polystyrene | 85% MEK | Dmax | 3.49 | 24 hr/B | 1.71 |
| | | Spd Pt | 2.03 | | |
| Dow Chemical | | Cont C | 2.74 | | |
| Poly(4-t-Butyl | 15% Resin | Dmin | 0.18 | 24 hr/V | 0.64 |
| Styrene) | 85% MEK | Dmax | 3.95 | 24 hr/B | 0.79 |
| | | Spd Pt | 2.10 | | |
| Aldrich Chemical | | Cont C | 3.30 | | |
| Tyril 880 | 15% Resin | Dmin | 0.30 | 24 hr/V | 2.00 |
| Styrene-Acrylonitrile | 85% MEK | Dmax | 2.80 | 24 hr/B | 2.29 |
| | | Spd Pt | 2.05 | | |
| Dow Chemical | | Cont C | 1.48 | | |
| Ethyl Cellulose N- | 4% Resin | Dmin | 0.46 | 24 hr/V | 0.35 |
| 200 | 43% MEK | Dmax | 3.94 | 24 hr/B | 0.52 |
| 48% Hydroxyl | 43% Toluene | Spd Pt | 2.04 | | |
| | 10% ETOH | Cont C | 3.26 | | |

-continued

| RESIN | RESIN PREMIX COMPOSITION | INITIAL | | LIGHT STABILITY | |
|---|---|---|---|---|---|
| Hercules | | | | | |
| Scripset 520 | 15% Resin | Dmin | 0.08 | 24 hr/V | 1.66 |
| Styrene-Maleic | 75% MEK | Dmax | 0.22 | 24 hr/B | 2.45 |
| Anhydride | 10% ETOH | Spd Pt | *** | | |
| Copolymer, | | Cont C | *** | | |
| Anhydride form | | | | | |
| (Monsanto) | | | | | |
| Scripset 540 | 18% Resin | Dmin | 0.10 | 24 hr/V | 1.22 |
| Styrene-Maleic | 74% MEK | Dmax | 3.11 | 24 hr/B | 1.58 |
| Anhydride | 8% ETOH | Spd Pt | 1.62 | | |
| Copolymer, | | Cont C | 2.83 | | |
| Ester/Acid form | | | | | |
| (Monsanto) | | | | | |
| Estane 5706 | 15% Resin | Dmin | 0.24 | 24 hr/V | 0.37 |
| Polyurethane | 75% MEK | Dmax | 2.84 | 24 hr/B | 0.58 |
| | 10% ETOH | Spd Pt | 1.99 | | |
| (Goodrich) | | Cont C | 2.86 | | |
| Estane 5715 | 15% Resin | Dmin | 0.18 | 24 hr/V | 0.15 |
| Polyurethane | 75% MEK | Dmax | 2.68 | 24 hr/B | 0.27 |
| | 10% ETOH | Spd Pt | 1.99 | | |
| (Goodrich) | | Cont C | 2.34 | | |
| Vitel PE 200 | 20% Resin | Dmin | 0.19 | 24 hr/V | 0.19 |
| (Vitel 2200) | 80% MEK | Dmax | 1.18 | 24 hr/B | 0.33 |
| Polyester | | Spd Pt | 0.49 | | |
| (Goodyear) | | Cont C | *** | | |
| Parlon S-10 | 15% Resin | Dmin | 0.14 | 24 hr/V | 0.49 |
| Chlorinated Rubber | 75% MEK | Dmax | 3.25 | 24 hr/B | 0.74 |
| | 10% ETOH | Spd Pt | 1.60 | | |
| Hercules | | Cont C | 3.05 | | |

The Example III resins demonstrate how difficult the topcoat resin choice is when taking into account both the sensitometry and print stability factors. Likewise silver and topcoat solution compatibility in the dual mode is important. The cellulose ester family clearly demonstrates the best mode of invention in all respects, when multicoating layer constructions are considered.

What is claimed:

1. A process for the manufacture of a photothermographic element comprising the steps of:

a) providing a substrate, b) coating a first layer on said substrate, said first layer comprising an organic polymeric binder, silver halide, reducible silver salt or silver complex, and an organic solvent, c) before 70% of the solvent in said first layer is removed from said first layer, coating a second layer comprising a solvent and a second polymeric binder onto said first layer, said second polymeric binder comprising at least one cellulose ester, at least one of said first layer and said second layer containing a reducing agent for silver ion.

2. The process of claim 1 wherein said cellulose ester is selected from the group consisting of cellulose acetate, cellulose acetate butyrate, and cellulose acetate propionate.

3. The process of claim 1 wherein said cellulose ester comprises at least 50% by weight of the second polymeric binder.

4. The process of claim 2 wherein said cellulose ester comprises at least 50% by weight of the second polymeric binder.

5. The process of claim 1 wherein said cellulose ester comprises at least 75 % by weight of the second polymeric binder.

6. The process of claim 2 wherein said cellulose ester comprises at least 75 % by weight of said second binder.

7. The process of claim 1 wherein said cellulose ester comprises at least 90% by weight of said second binder.

8. The process of claim 2 wherein said cellulose ester comprises at least 90% by weight of said second binder.

9. The process of claim 1 wherein said second layer is coated on said first layer before 50% of said solvent in said first layer is removed.

10. The process of claim 2 wherein said second layer is coated on said first layer before 50% by weight of said solvent in said first layer is removed.

11. The process of claim 4 wherein said second layer is coated on said first layer before 50% by weight of said solvent in said first layer is removed.

12. The process of claim 6 wherein said second layer is coated on said first layer before 50% of said solvent in said first layer is removed.

13. The process of claim 8 wherein stud second layer is coated on said first layer before 50% by weight of said solvent in said first layer is removed.

14. The process of claim 1 wherein said second layer is coated on said first layer before 30% by weight of said solvent in said first layer is removed.

15. The process of claim 8 wherein said second layer is coated on said first layer before 30% by weight of said solvent in said first layer is removed.

16. The process of claim 1 wherein said substrate is a transparent polymeric film.

17. The process of claim 2 wherein said substrate is a transparent polymeric film.

18. The process of claim 8 wherein said substrate is a transparent polymeric film.

19. The process of claim 15 wherein said substrate is a transparent polymeric film.

20. A process for the manufacture of a black-and white photothermographic element comprising the steps of:

a) providing a substrate, b) coating a first layer on said substrate, said first layer comprising an organic polymeric binder, silver halide, reducible silver salt or silver complex, and an organic solvent, and c) before 70% of the solvent in said first layer is removed from said first layer, coating a second layer comprising a solvent and a second polymeric binder onto said first layer, said second polymeric binder comprising at least one cellulose ester, at least one of said first and second layer containing a reducing agent for silver ion.

21. The process of claim 20 wherein said cellulose ester is selected from the group consisting of cellulose acetate, cellulose acetate butyrate, and cellulose acetate propionate.

* * * * *

UNITED STATES PATENT AND TRADEMARK OFFICE

CERTIFICATE OF CORRECTION

PATENT NO. : 5,405,740

DATED : April 11, 1995

INVENTOR(S) : LaBelle

It is certified that error appears in the above-indentified patent and that said Letters Patent is hereby corrected as shown below:

Column 7, line 26, delete "his" and insert --bis--.

Column 8, line 7, delete "dement" and insert --element--.

Column 11, line 9, delete "Drain" and insert --Dmin--.

Column 11, TABLE I, last line, delete "AB171-15S" and insert --CAB171-15S--.

Column 14, line 60, delete "Drain" and insert --Dmin--.

Column 18, line 44, delete "stud" and insert --said--.

Signed and Sealed this

Fourth Day of July, 1995

Bruce Lehman

*Attest:*

BRUCE LEHMAN

*Attesting Officer*

*Commissioner of Patents and Trademarks*